United States Patent [19]

Majurinen

[11] Patent Number: 4,945,695

[45] Date of Patent: Aug. 7, 1990

[54] ARRANGEMENT IN AN INTERMEDIATE FLOOR OR THE BASE FLOOR OF A BUILDING

[75] Inventor: Joel Majurinen, Espoo, Finland

[73] Assignee: Insinooritoimisto Joel Majurinen Ky, Helsinki, Finland

[21] Appl. No.: 377,591

[22] Filed: Jul. 10, 1989

[30] Foreign Application Priority Data

Dec. 29, 1988 [FI] Finland ..... 886034

[51] Int. Cl.[5] ..... E04B 1/00

[52] U.S. Cl. ..... 52/252; 52/262; 52/220; 52/251

[58] Field of Search ..... 52/252, 220, 221, 236.7, 52/262, 263, 251, 259, 606

[56] References Cited

U.S. PATENT DOCUMENTS 3,950,902 4/1976 Stout ..... 52/262 X

*Primary Examiner*—David A. Scherbel

*Assistant Examiner*—Creighton Smith

[57] ABSTRACT

The specification relates to an arrangement in an intermediate floor or the base floor of a building, producing a duct system for electrical or HEPAC installations. At the end of the cored slabs (1) there is produced, by means of a supporting component (3), a transverse duct which communicates with the cores (6) of the cored slabs. The duct may also be formed by means of a channel beam which adjoins the end surfaces (5) and has openings in alignment with the cores (6). The transverse duct is preferably covered with a separate cover (4).

6 Claims, 5 Drawing Sheets

ARRANGEMENT IN AN INTERMEDIATE FLOOR OR THE BASE FLOOR OF A BUILDING

Figure 1:
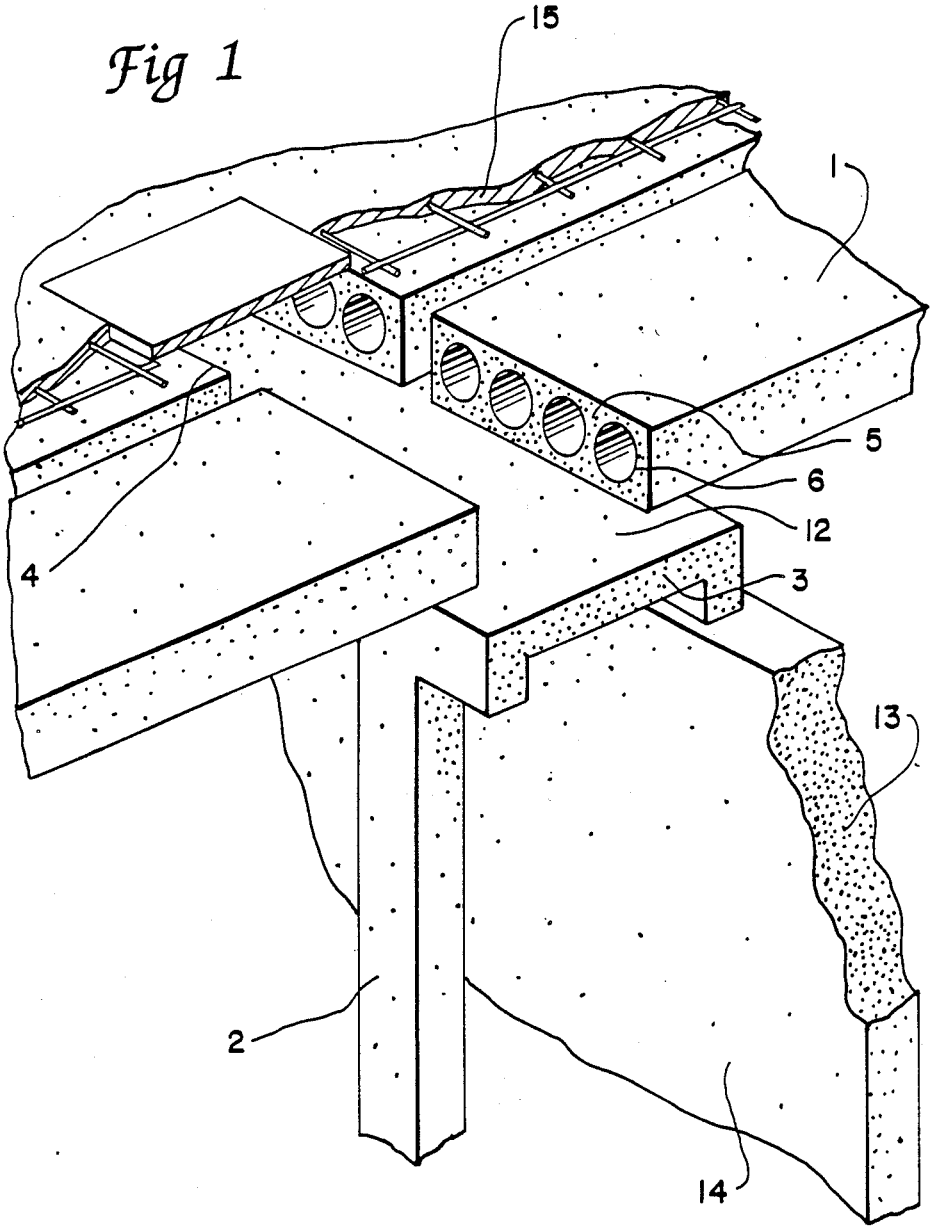

The present invention relates to an arrangement in an intermediate floor or the base floor of a building, which floor has cored slabs placed adjacently, with their ends resting on a wall or on columns.

For various electrical, telecommunications and HEPAC installations it is known to arrange, in the base floor or an intermediate floor of a building, ducts running crosswise. One known method to produce such ducts is to use variously profiled metal sheets as the casting mold, in which case the ducts are formed inside the profiles. By additionally placing vertical interconnectors at different points in the profiles, for example in the form of a cut pipe, a connection is obtained from the ducts to the surface of the base floor or of the intermediate floor, for example at the point where a partition wall will be.

It is, however, clear that solutions such as this, in which specifically formed profiles are used and the casting is performed in situ, are relatively expensive.

The object of the present invention is therefore to provide an arrangement in which, by using the most commonly used so-called cored slabs, which are known to be good, it is possible to construct a duct system for subsequent HEPAC and electrical installations. To achieve this, the arrangement according to the invention is characterized in that, at the ends of adjacent cored slabs there is arranged an open connection between the cores ending at the end surfaces of at least two slabs, either by leaving an empty space at the ends of the cored slabs or by fastening to the ends a separate structural component which forms a transverse duct.

The open space or the said channel component is preferably arranged between those ends of two cored-slab rows which face each other. The duct formed can be covered, for example, in part by a partition wall or by a separate cover which can be opened.

The invention and its other characteristics are described below in greater detail in the form of examples and with reference to the accompanying drawing, in which FIGS. 1–5 are perspective representations of different embodiments of the arrangement according to the invention.

In the figures, reference numeral 1 indicates a conventional cored slab which has through-going holes 6 extending in the longitudinal direction of the slab. The cored slabs 1 are placed in a known manner adjacently so that they form a continuous intermediate floor.

In FIG. 1, a supporting beam 3 has been installed on top of a partition wall or columns 2 in such a manner that one cored-slab row rests on each edge of the beam and that above the middle of the beam there is formed an open space between the end surfaces 5 of the cored slabs 1.

When the space between the cored slabs is covered with a cover 4, an open duct 12 is formed which extends in a direction transverse to the cores 6 and thus enables all kinds of electrical, telecommunications and HEPAC installations to be made afterwards. Of course, there may also be openings or notches in the cover 4 to enable lines to be drawn upwards from the duct. In a corresponding manner, the supporting beam 3 may have openings which enable lines to be drawn downwards.

Reference numeral 13 indicates a loadbearing partition wall. After the HEPAC and electrical installations have been made, the spaces between the columns 2 are filled with a wall, whereupon the installations are left in the intermediate space 14.

Reference numeral 15 indicates a possible floor topping.

Figure 2:
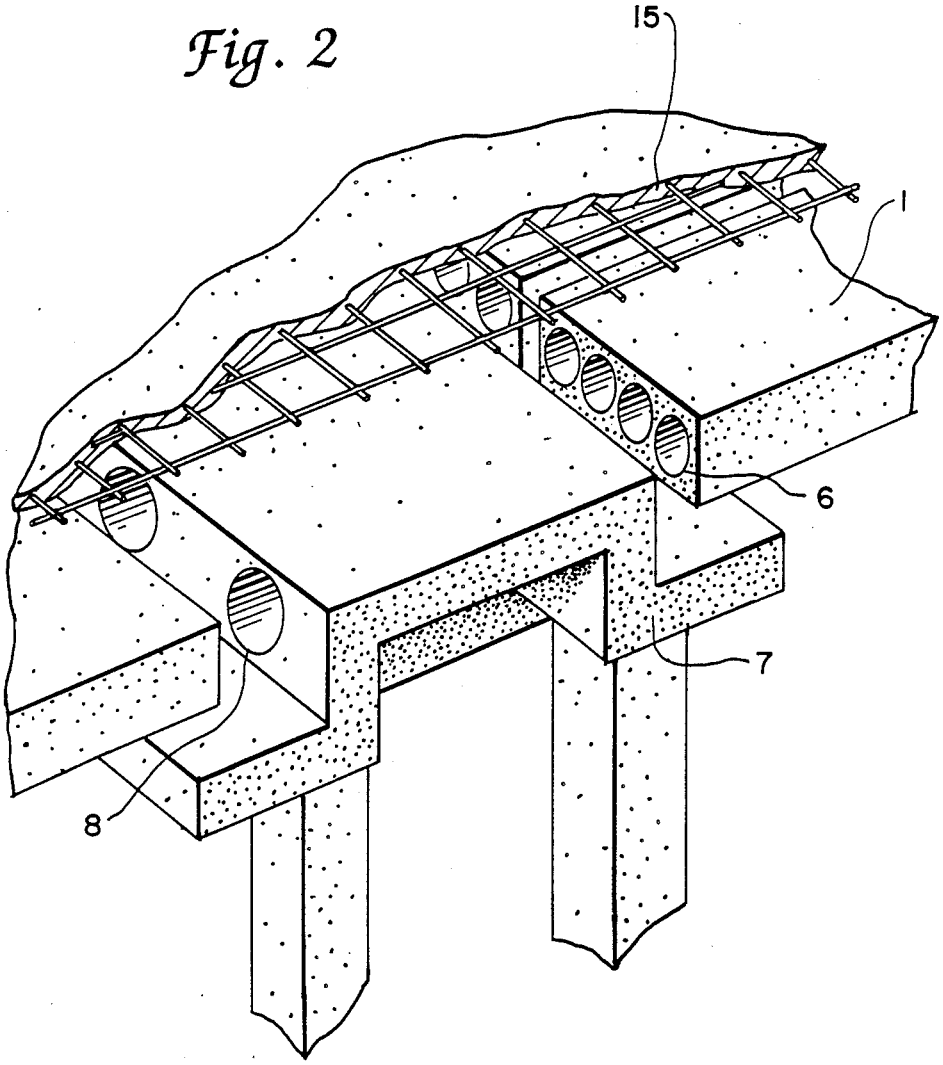

FIG. 2 depicts another alternative of the arrangement according to the invention. In it the supporting beam 7 has the cross-sectional shape of a wide inverted U, and in the vertical sides of the beam there are openings 8 the spacing of which corresponds to the spacing of the cores 6. In this manner there is formed inside the beam 7 a transverse duct which communicates via the openings 8 with the cores 6 of the slabs 1. It is, of course, again possible to make holes in the upper side of the beam 7 for the drawing of lines upwards.

Figure 3:
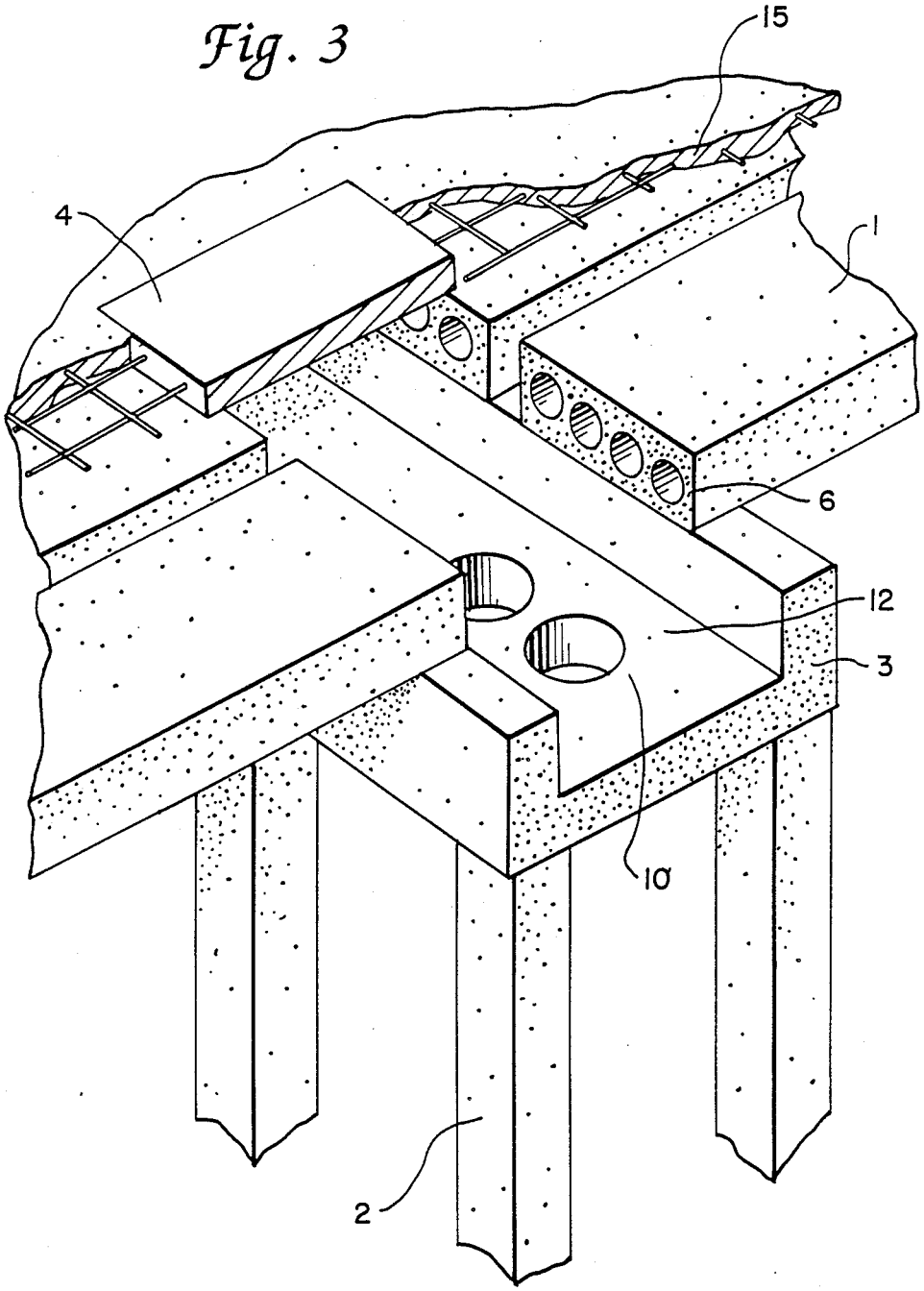

The embodiment in FIG. 3 corresponds to FIG. 1 in that the beam 3 is similar, but turned the other way. The beam may have holes 10 through which the duct 12 communicates with the space between t columns 2.

Figure 4:
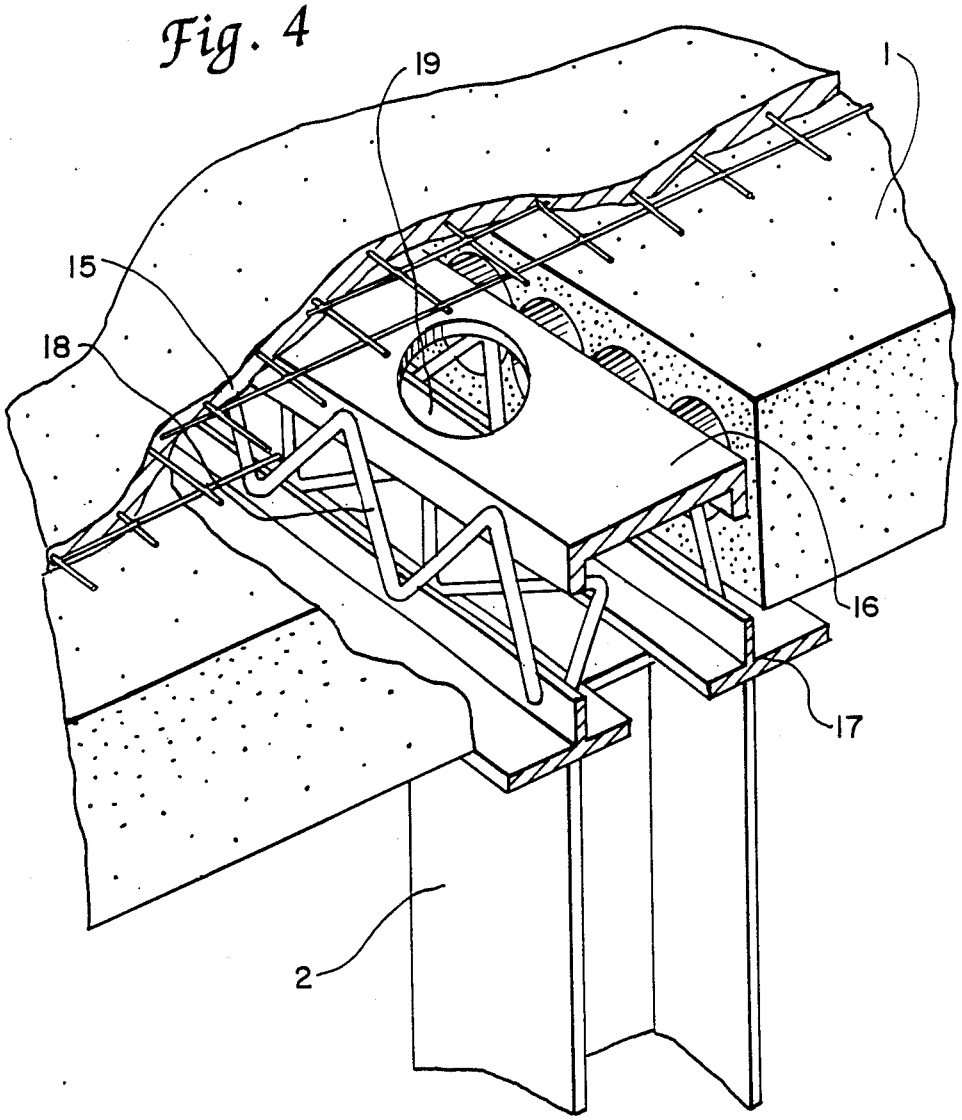

The beam of FIG. 4 differs from those described above, and it is made up of one upper U-beam 16 which is connected by means of tie bars 18 to two lower T beams 17. The lower beams are also interconnected by means of tie bars. The connections to the sides, to the cores 6, are formed between the tie bars 18, and the connection upwards through holes 19 in the beam 16.

Figure 5:
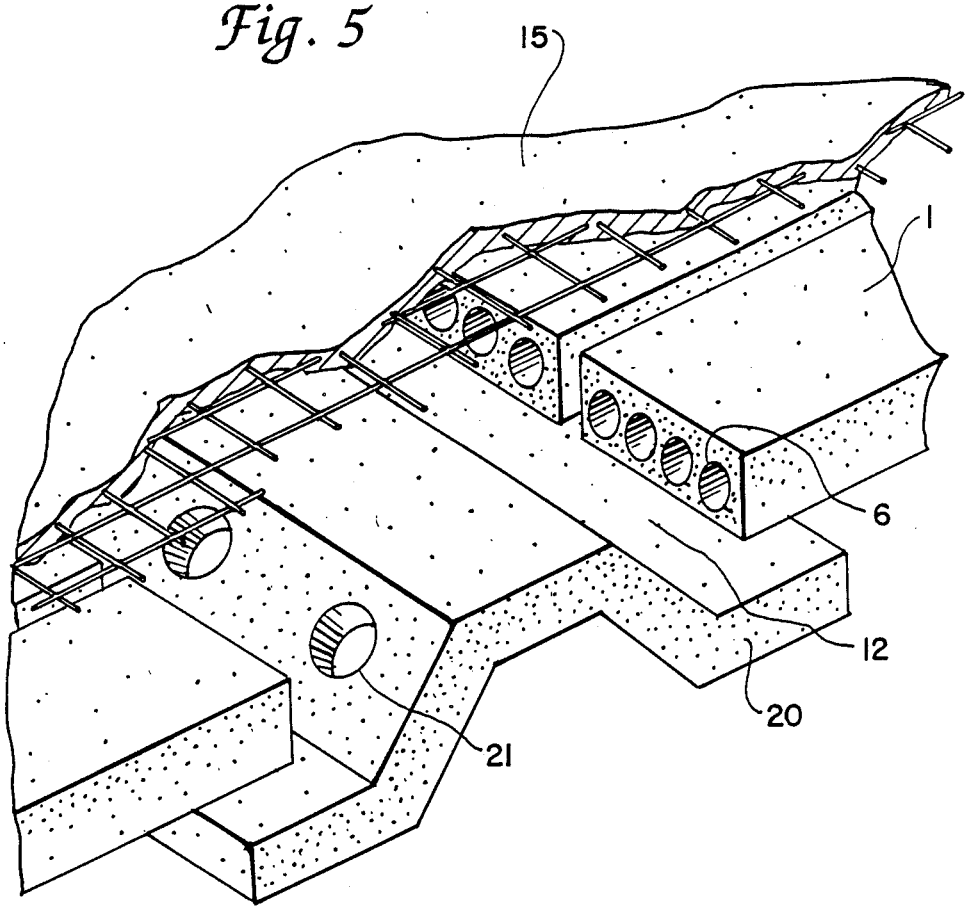

Finally FIG. 5 depicts one more embodiment, in which the sides, provided with holes 21, of the load-bearing beam 20 are diagonal. In other respects the arrangement functions in the same manner as in FIG. 2.

The arrangement according to the invention is especially advantageous for use in, for example, industrial buildings, laboratory buildings, and open-plan offices.

It is clear that the arrangement may, within the idea of the invention and the scope of the following patent claims, deviate from the examples described above.

I claim:

1. In a floor arrangement having two rows of adjacently placed cored slabs, each row of slabs defining at least one set of adjacent ends, the set of adjacent ends of one row being disposed opposite the set of adjacent ends of the other row and spaced apart to define a space between them, a common transverse component supporting the set of ends of each of the two rows, and two walls spaced apart subtending the transverse component for supporting the transverse component.

2. An arrangement according to claim 1, wherein the space between the walls and the space between the rows is connected.

3. An arrangement according to claim 1, wherein the transverse component has, in alignment with the ends of the slab rows, flanges corresponding in their height approximately to the thickness of the slabs, and that the flanges have openings communicating with at least some of the cores.

4. An arrangement according to claim 1, wherein the transverse component is made up of at least one upper steel beam and at least one lower steel beam, these beams being interconnected by means of side components through which there is a connection to the cores of the cored slabs.

5. An arrangement according to claim 4, wherein the side components are tie bars fastened by welding to the upper and lower steel beams.

6. An arrangement according to claim 4, further comprising two lower beams at an interval from each other, the beams being interconnected pg,8 by means of tie components between which there is a connection from the space between the slabs into the space between the walls beneath.

* * * * *